US007686024B1

(12) United States Patent
Lai

(10) Patent No.: US 7,686,024 B1
(45) Date of Patent: Mar. 30, 2010

(54) UMBRELLA HAVING A DETACHABLE STRUCTURE

(75) Inventor: Jin-Sheng Lai, Taipei (TW)

(73) Assignee: Galtech Computer Corp., Newbury Park, CA (US)

( * ) Notice: Subject to any disclaimer, the term of this patent is extended or adjusted under 35 U.S.C. 154(b) by 0 days.

(21) Appl. No.: 12/330,995

(22) Filed: Dec. 9, 2008

(51) Int. Cl.
*A45B 25/00* (2006.01)

(52) U.S. Cl. ..... 135/29

(58) Field of Classification Search ..... 135/19.5, 135/15.1, 29, 31, 98; 16/229, 380
See application file for complete search history.

(56) References Cited

U.S. PATENT DOCUMENTS 947,790 A * 2/1910 Carter ..... 135/31
959,127 A * 5/1910 Edwards ..... 135/31
1,289,334 A * 12/1918 Whitcoon ..... 135/31
1,678,414 A * 7/1928 Zwiebel ..... 135/31
1,684,628 A * 9/1928 Jensen ..... 135/15.1
2,105,225 A * 1/1938 Pollock ..... 135/30
2,385,575 A * 9/1945 Isler ..... 135/29
3,217,374 A * 11/1965 Sang ..... 24/265 B
3,977,044 A * 8/1976 Mort ..... 16/380
4,326,321 A * 4/1982 Colognori ..... 24/265 B
5,193,566 A * 3/1993 Chen ..... 135/28
6,802,329 B2 * 10/2004 Chen ..... 135/135

* cited by examiner

*Primary Examiner*—David Dunn
*Assistant Examiner*—Noah Chandler Hawk
(74) *Attorney, Agent, or Firm*—Alan Kamrath; Kamrath & Associates PA

(57) ABSTRACT

An umbrella includes a shank, a fixed ring mounted on the shank, a movable ring movably mounted on the shank, a plurality of ribs each pivotally and detachably connected with the fixed ring, and a plurality of spreaders each pivotally and detachably connected with the movable ring. Thus, each of the spreaders and the ribs can be removed from the movable ring and the fixed ring respectively for replacement or maintenance, thereby enhancing the lifetime of the umbrella.

8 Claims, 12 Drawing Sheets

UMBRELLA HAVING A DETACHABLE STRUCTURE

BACKGROUND OF THE INVENTION

1. Field of the Invention

The present invention relates to an umbrella and, more particularly, to a umbrella to provide a shading effect.

2. Description of the Related Art

A conventional umbrella comprises a shank, a fixed ring mounted on the upper end of the shank, a movable ring movably mounted on the shank, a base mounted on the lower end of the shank, a plurality of ribs each pivotally mounted on the fixed ring, a plurality of spreaders each pivotally mounted on the movable ring and each pivotally connected with a respective one of the ribs, and a canopy mounted on the ribs. However, the ribs are secured on the fixed ring, and the spreaders are secured on the movable ring, so that the spreaders and the ribs cannot be detached from the fixed ring and the movable ring for replacement. Thus, when one of the spreaders or the ribs is broken or worn out, the umbrella is inoperative and has to be thrown away, thereby decreasing the lifetime of the umbrella.

BRIEF SUMMARY OF THE INVENTION

In accordance with the present invention, there is provided a umbrella, comprising a shank, a fixed ring mounted on the shank, a movable ring movably mounted on the shank, a plurality of ribs each pivotally and detachably connected with the fixed ring, and a plurality of spreaders each pivotally and detachably connected with the movable ring.

The primary objective of the present invention is to provide an umbrella having a detachable structure.

Another objective of the present invention is to provide an umbrella, wherein each of the spreaders and the ribs can be detached from the respective connecting pipe, so that each of the spreaders and the ribs can be removed from the movable ring and the fixed ring respectively for replacement or maintenance, thereby enhancing the lifetime of the umbrella.

A further objective of the present invention is to provide an umbrella, wherein each of the spreaders and the ribs can be mounted on and detached from the respective connecting pipe by operation of the locking stub of each of the locking mechanisms, so that each of the spreaders and the ribs of the umbrella is assembled and disassembled easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
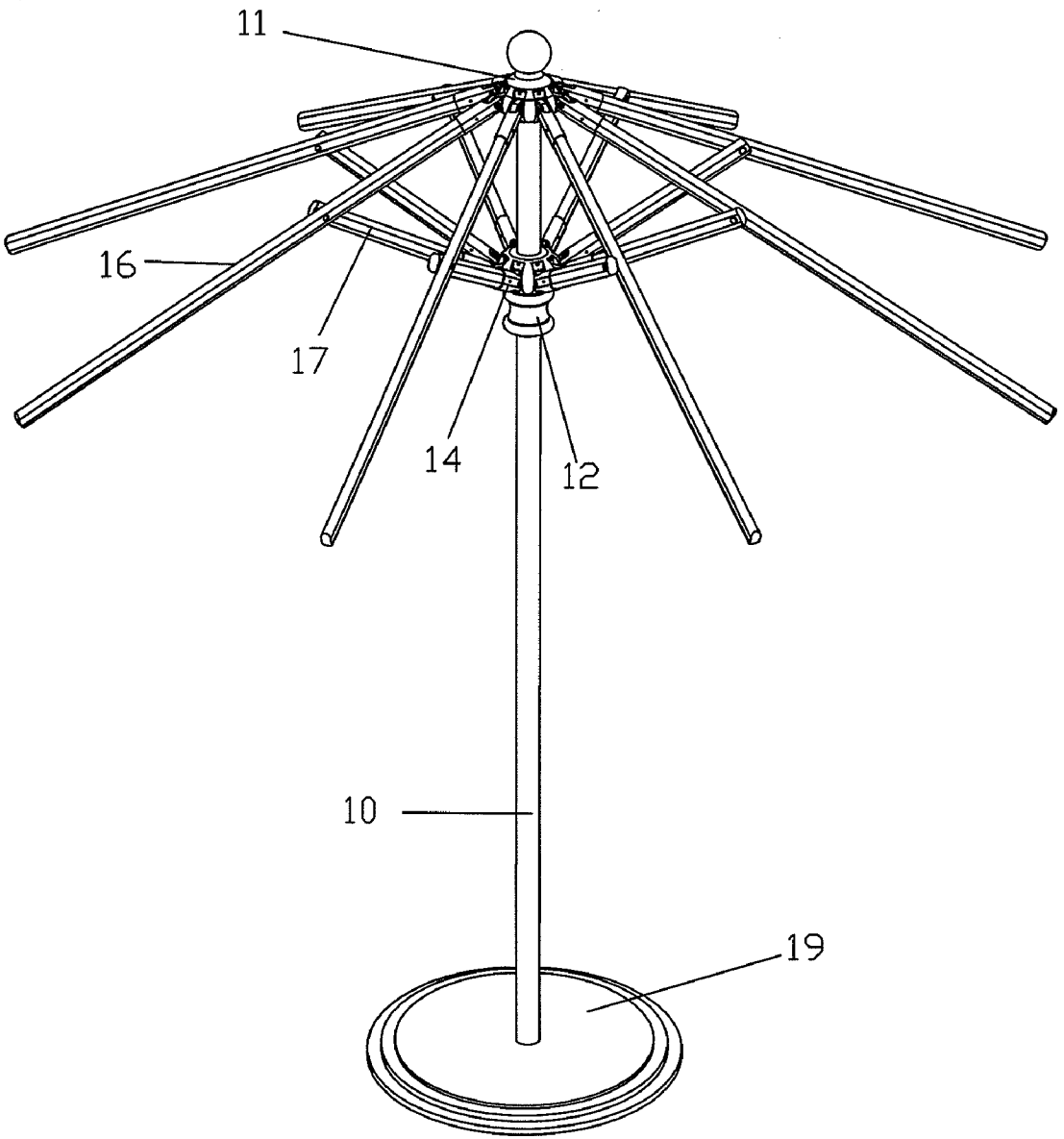
FIG. 1 is a perspective view of an umbrella in accordance with the preferred embodiment of the present invention.
Figure 2:
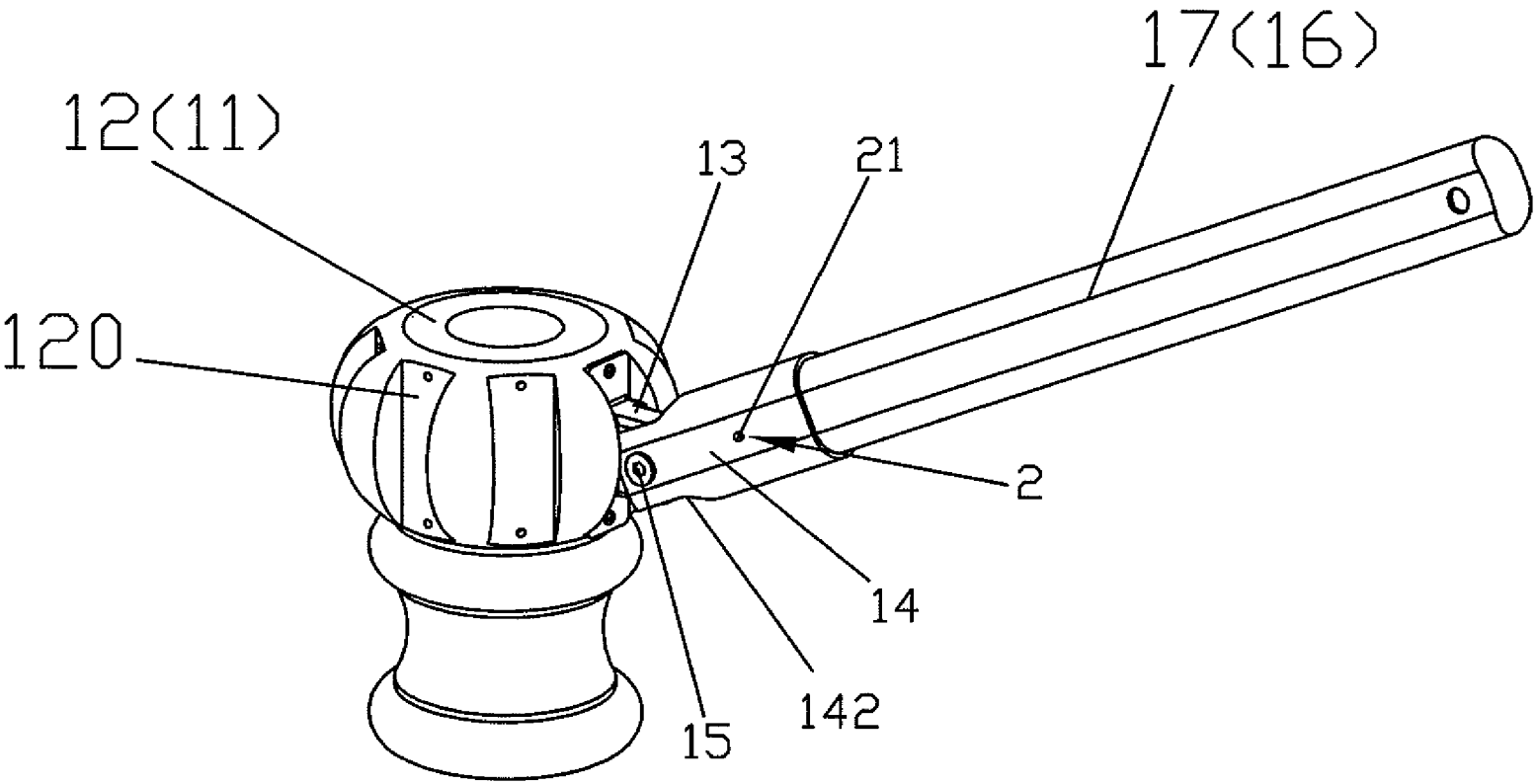
FIG. 2 is a locally enlarged view of the umbrella as shown in FIG. 1.
Figure 3:
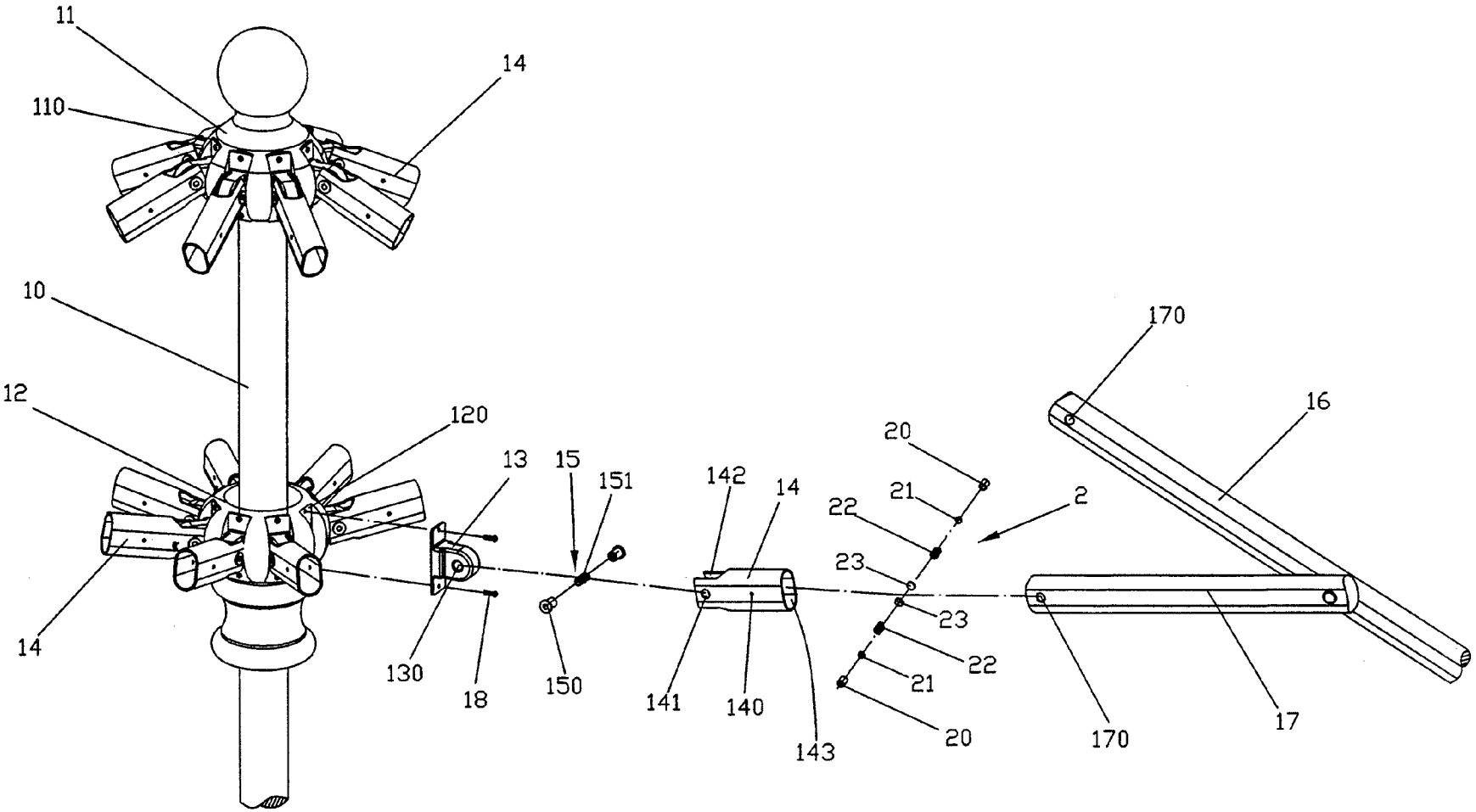
FIG. 3 is a partially exploded perspective view of the umbrella as shown in FIG. 1.
Figure 4:
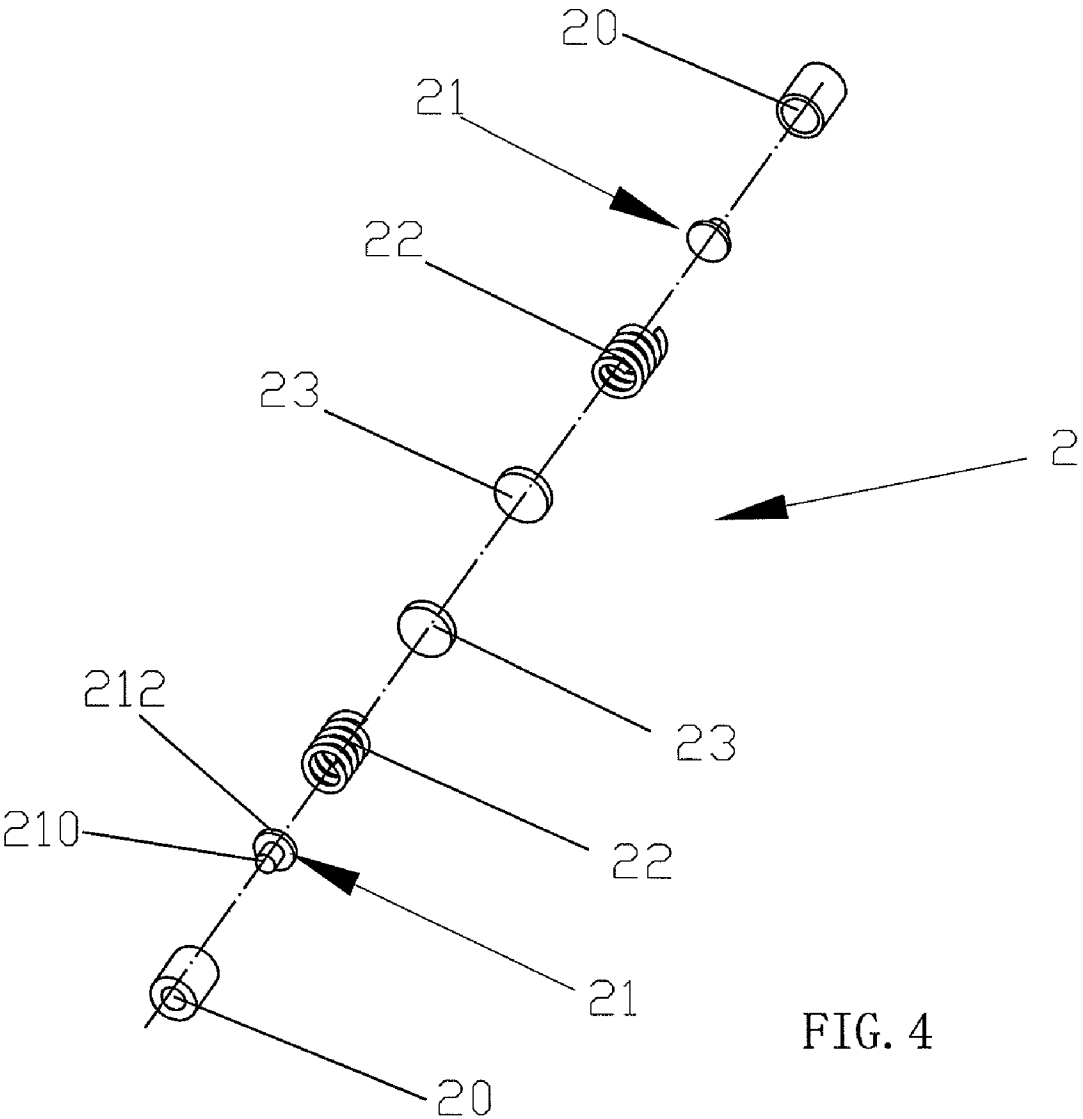
FIG. 4 is a locally enlarged view of a locking mechanism of the umbrella as shown in FIG. 3.
Figure 5:
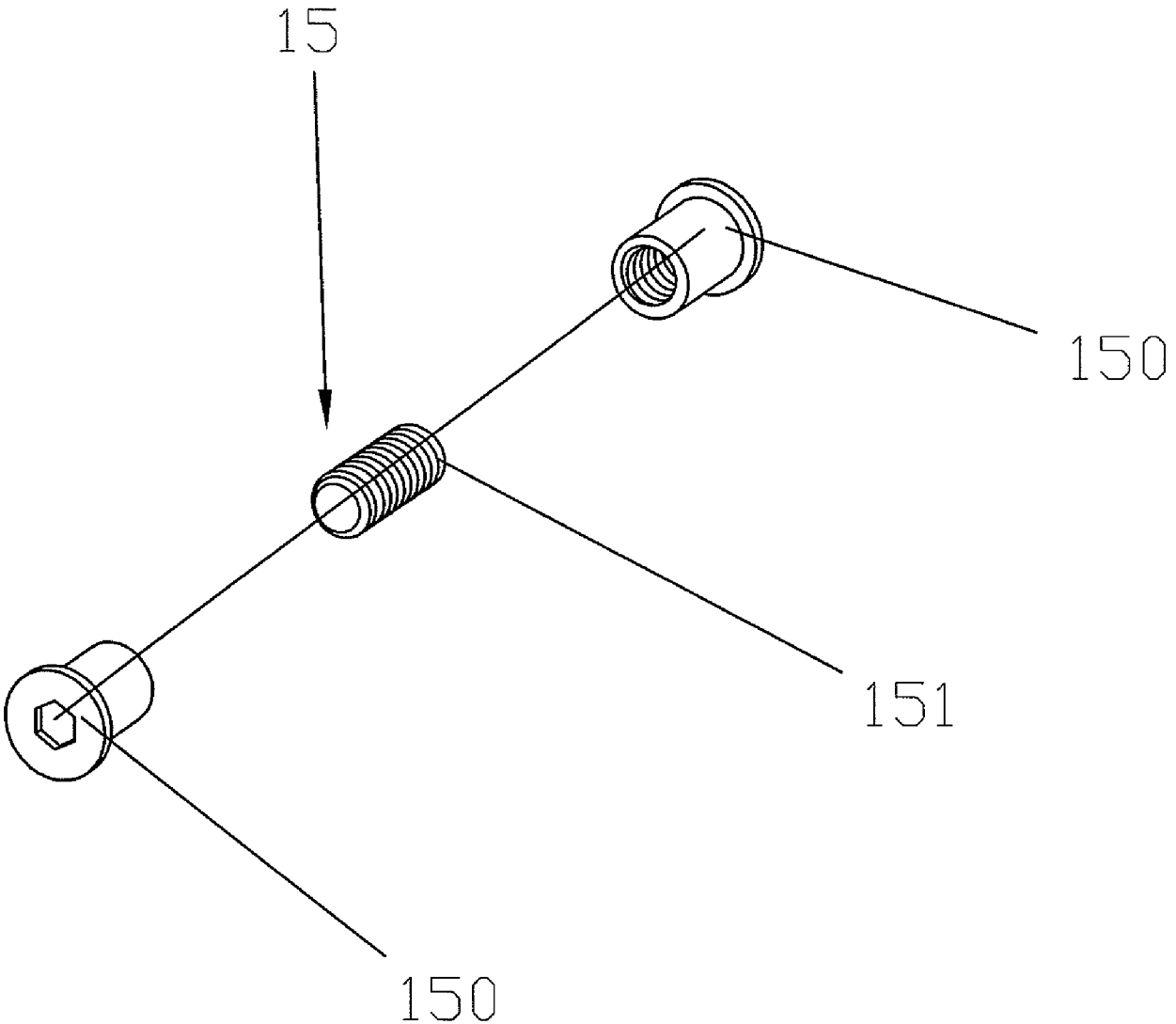
FIG. 5 is a locally enlarged view of a fastening mechanism of the umbrella as shown in FIG. 3.
Figure 6:
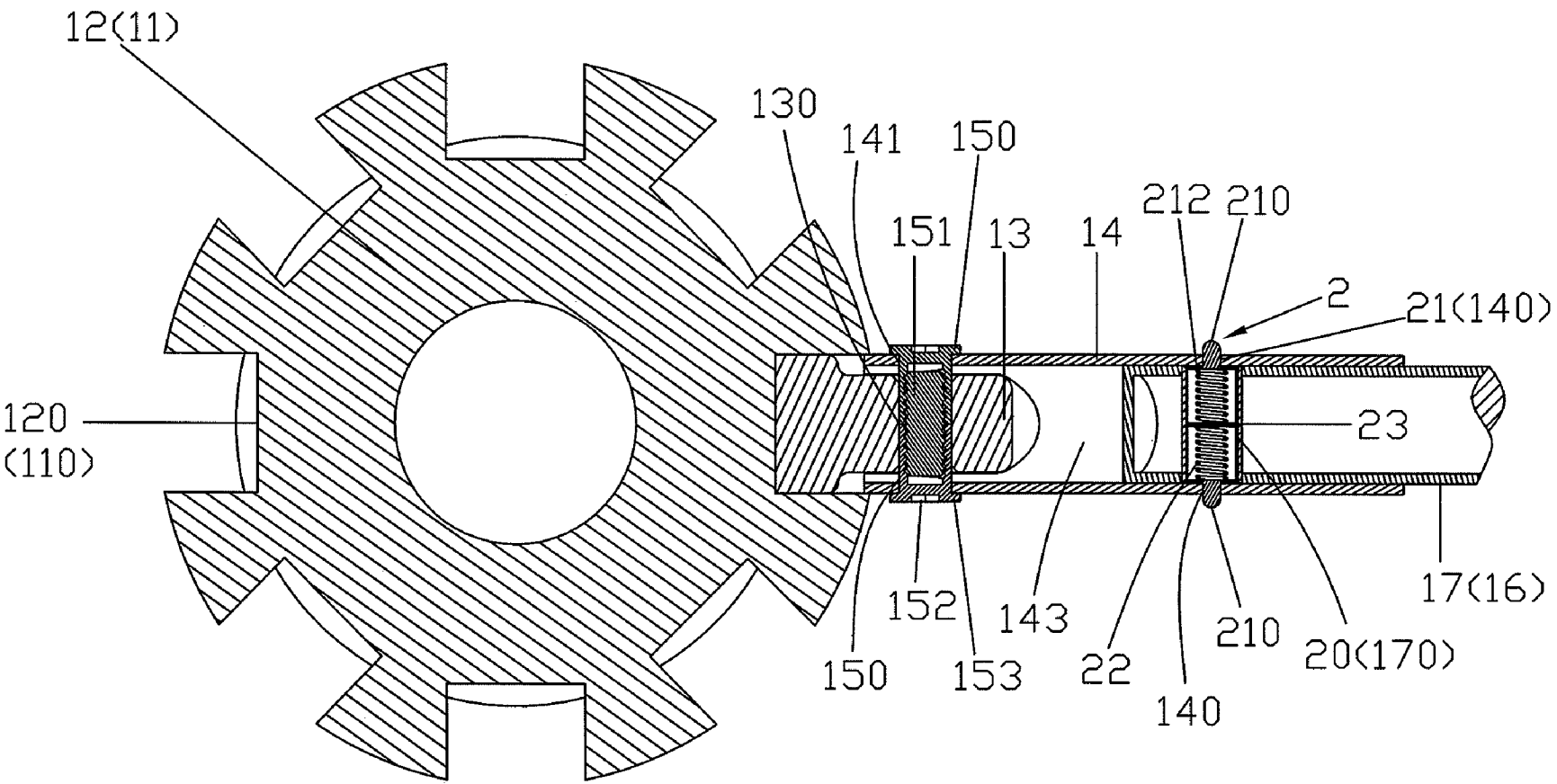
FIG. 6 is a top cross-sectional assembly view of the umbrella as shown in FIG. 2.
Figure 7:
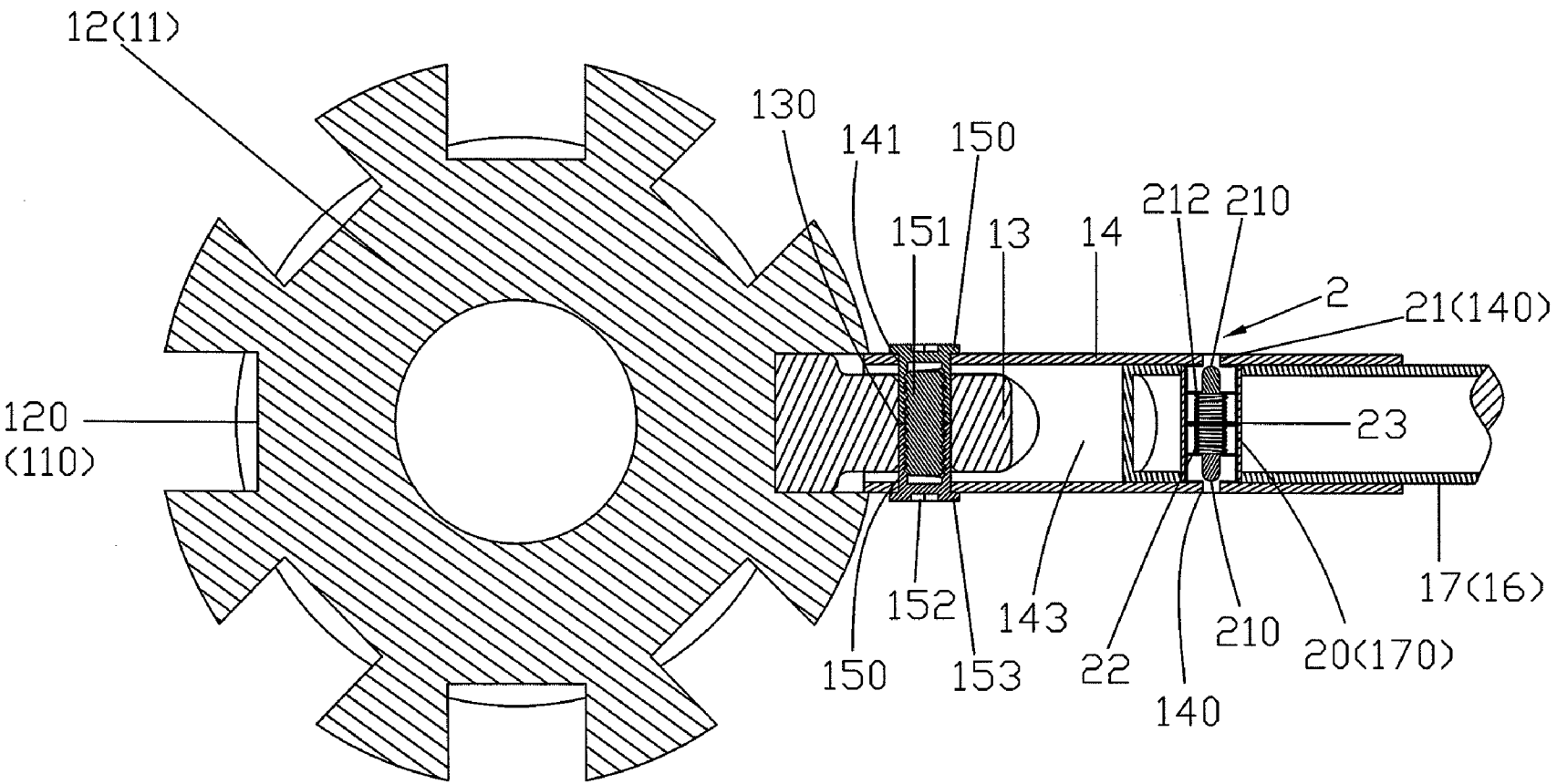
FIG. 7 is a schematic operational view of the as shown in FIG. 6.
Figure 8:
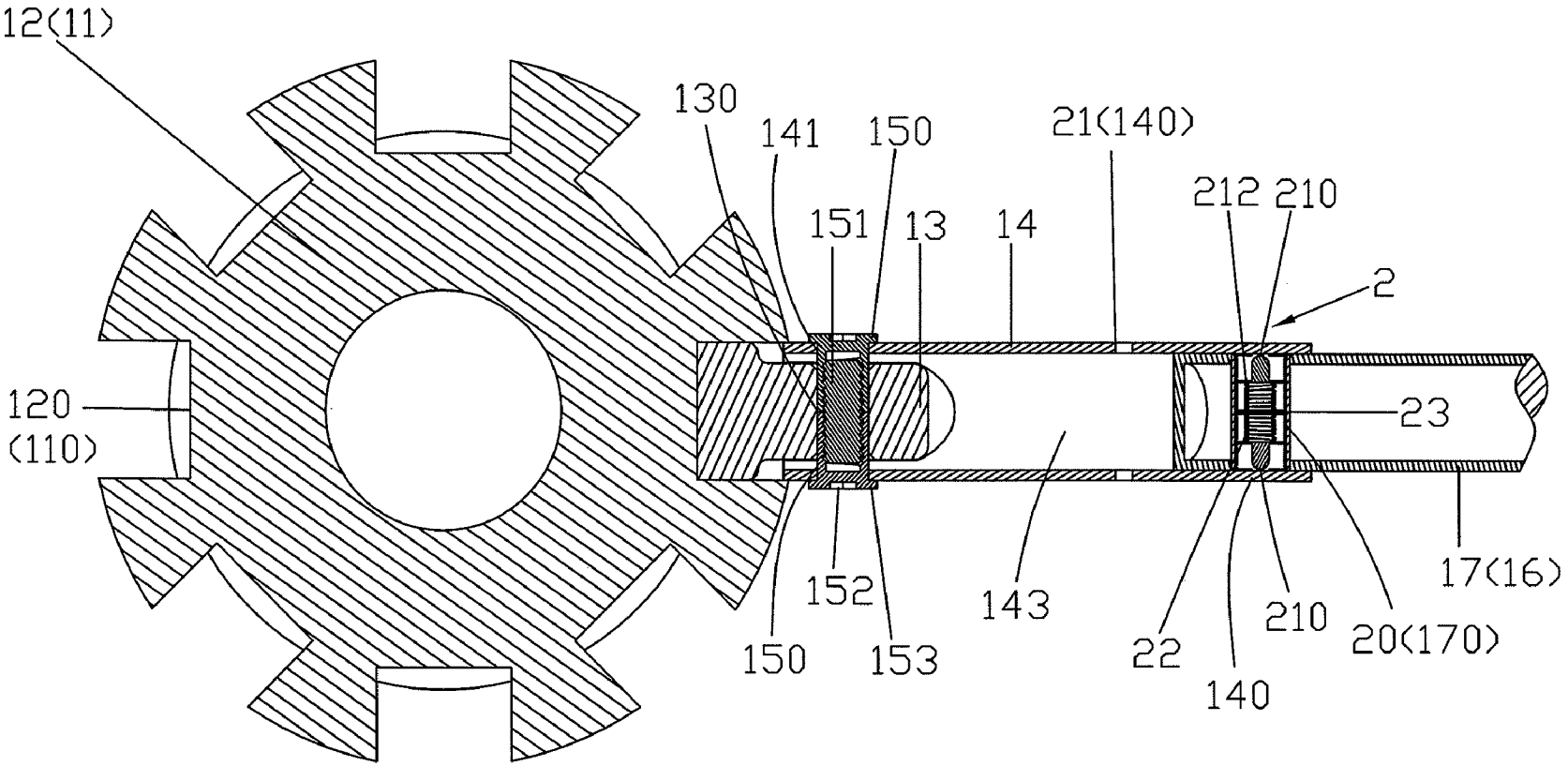
FIG. 8 is a schematic operational view of the as shown in FIG. 7.
Figure 9:
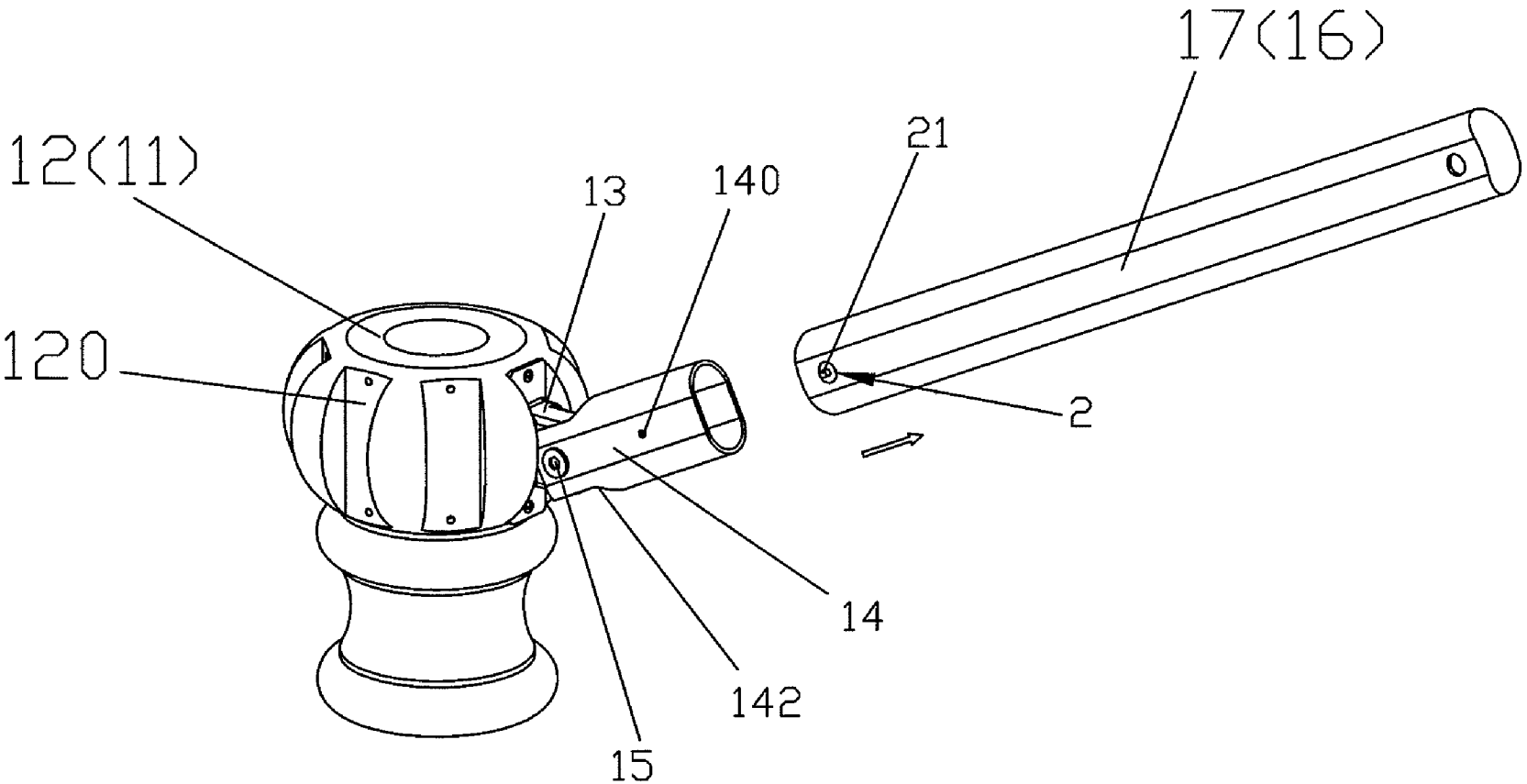
FIG. 9 is an exploded perspective view of the umbrella as shown in FIG. 2.

Referring to the drawings and initially to FIGS. 1-6, an umbrella in accordance with the preferred embodiment of the present invention comprises a shank 10, a fixed ring 11 mounted on the upper end of the shank 10, a movable ring 12 movably mounted on the shank 10, a base 19 mounted on the lower end of the shank 10, a plurality of ribs 16 each pivotally and detachably connected with the fixed ring 11, and a plurality of spreaders 17 each pivotally and detachably connected with the movable ring 12.

The umbrella further comprises a plurality of mounting brackets 13 secured on the fixed ring 11 and the movable ring 12 respectively, a plurality of connecting pipes 14 each pivotally and detachably connected with a respective one of the mounting brackets 13, a plurality of fastening mechanisms 15 each mounted between a respective one of the mounting brackets 13 and a respective one of the connecting pipes 14 to detachably mount the respective connecting pipe 14 onto the respective mounting bracket 13, and a plurality of locking mechanisms 2 each mounted in a respective one of the ribs 16 and the spreaders 17 and each detachably locked onto a respective one of the connecting pipes 14 to detachably lock each of the ribs 16 and the spreaders 17 onto the respective connecting pipe 14.

The fixed ring 11 has a periphery provided with a plurality of receiving grooves 110 to receive the mounting brackets 13 respectively. The movable ring 12 has a periphery provided with a plurality of receiving grooves 120 to receive the mounting brackets 13 respectively.

Each of the mounting brackets 13 is secured in the respective receiving groove 110 of the fixed ring 11 and the respective receiving groove 120 of the movable ring 12 by a plurality of locking screws 18. Each of the mounting brackets 13 is provided with a fixing hole 130 to receive the respective fastening mechanism 15.

Each of the connecting pipes 14 is pivotally and detachably mounted on the respective mounting bracket 13 by the respective fastening mechanism 15. Each of the connecting pipes 14 is provided with at least one locking hole 140 to releasably lock the respective locking mechanism 2. Each of the connecting pipes 14 has an inner portion provided with a receiving chamber 143 connected to the locking hole 140 to receive a respective one of the ribs 16 and the spreaders 17. Each of the connecting pipes 14 has an end portion provided with a forked pivot ear 142 pivotally and detachably mounted on the respective mounting bracket 13. The pivot ear 142 of each of the connecting pipes 14 is provided with a pivot hole 141 aligning with the fixing hole 130 of the respective mounting bracket 13.

Each of the fastening mechanisms 15 includes two juxtaposed threaded sleeves 150 extending through the pivot hole 141 of the respective connecting pipe 14 and the fixing hole 130 of the respective mounting bracket 13, and a threaded rod 151 screwed into the two threaded sleeves 150 to connect the two threaded sleeves 150. Each of the two threaded sleeves 150 of each of the fastening mechanisms 15 has an end portion provided with an enlarged limit flange 153 protruding outwardly from the pivot hole 141 of the respective connecting pipe 14 and abutting the pivot ear 142 of the respective connecting pipe 14. The limit flange 153 of each of the two threaded sleeves 150 has a surface provided with a hexagonal drive slot 152 to allow insertion of a tool tip (not shown) to facilitate rotation of each of the two threaded sleeves 150 relative to the threaded rod 151. The threaded rod 151 of each of the fastening mechanisms 15 is received in the two threaded sleeves 150.

Each of the ribs 16 is detachably mounted on the respective connecting pipe 14 by the respective locking mechanism 2. Each of the ribs 16 is pivotally connected with a respective one of the spreaders 17. Each of the spreaders 17 is detachably mounted on the respective connecting pipe 14 by the respective locking mechanism 2. Each of the spreaders 17 and the ribs 16 is provided with a receiving hole 170 to receive a respective one of the locking mechanisms 2.

Each of the locking mechanisms 2 includes at least one locking stub 21 movably mounted in the receiving hole 170 of the respective spreader 17 and the respective rib 16 and detachably locked in the locking hole 140 of the respective connecting pipe 14 to detachably lock the respective spreader 17 and the respective rib 16 onto the respective connecting pipe 14, and at least one elastic member 22 mounted in the receiving hole 170 of the respective spreader 17 and the respective rib 16 and pressing the locking stub 21 to push the locking stub 21 outwardly from the locking hole 140 of the respective connecting pipe 14.

Each of the locking mechanisms 2 further includes at least one housing 20 secured in the receiving hole 170 of the respective spreader 17 and the respective rib 16 to receive the locking stub 21 and the elastic member 22, and at least one fixing plate 23 secured in the housing 20 and abutting the elastic member 22. The locking stub 21 of each of the locking mechanisms 2 has a first end provided with an enlarged limit plate 212 movably mounted in the housing 20 and movable to abut a peripheral wall of the housing 20 to limit the locking stub 21 on the housing 20. The locking stub 21 of each of the locking mechanisms 2 has a second end provided with an arcuate guide portion 210 protruding outwardly from the locking hole 140 of the respective connecting pipe 14 to guide movement of the locking stub 21 in the locking hole 140 of the respective connecting pipe 14. The elastic member 22 of each of the locking mechanisms 2 is biased between the fixing plate 23 and the limit plate 212 of the locking stub 21.

In operation, referring to FIGS. 6-9 with reference to FIGS. 1-5, when the locking stub 21 of each of the locking mechanisms 2 is pressed to retract into the locking hole 140 of the respective connecting pipe 14, the arcuate guide portion 210 of the locking stub 21 is moved to abut the inner wall of the respective connecting pipe 14, so that the locking stub 21 of each of the locking mechanisms 2 is unlocked from the locking hole 140 of the respective connecting pipe 14, and each of the spreaders 17 and the ribs 16 is unlocked from the respective connecting pipe 14. Thus, when each of the spreaders 17 and the ribs 16 is pulled outwardly relative to the respective mounting connecting pipe 14, the locking stub 21 of each of the locking mechanisms 2 is detached from the locking hole 140 of the respective connecting pipe 14 by guidance of the arcuate guide portion 210 of the locking stub 21 and is retracted into and moved in the receiving chamber 143 of the respective connecting pipe 14, so that each of the spreaders 17 and the ribs 16 can be moved outwardly and removed from the respective connecting pipe 14.

Accordingly, each of the spreaders 17 and the ribs 16 can be detached from the respective connecting pipe 14, so that each of the spreaders 17 and the ribs 16 can be removed from the movable ring 12 and the fixed ring 11 respectively for replacement or maintenance, thereby enhancing the lifetime of the umbrella. In addition, each of the spreaders 17 and the ribs 16 can be mounted on and detached from the respective connecting pipe 14 by operation of the locking stub 21 of each of the locking mechanisms 2, so that each of the spreaders 17 and the ribs 16 of the umbrella is assembled and disassembled easily and quickly.

Figure 10:
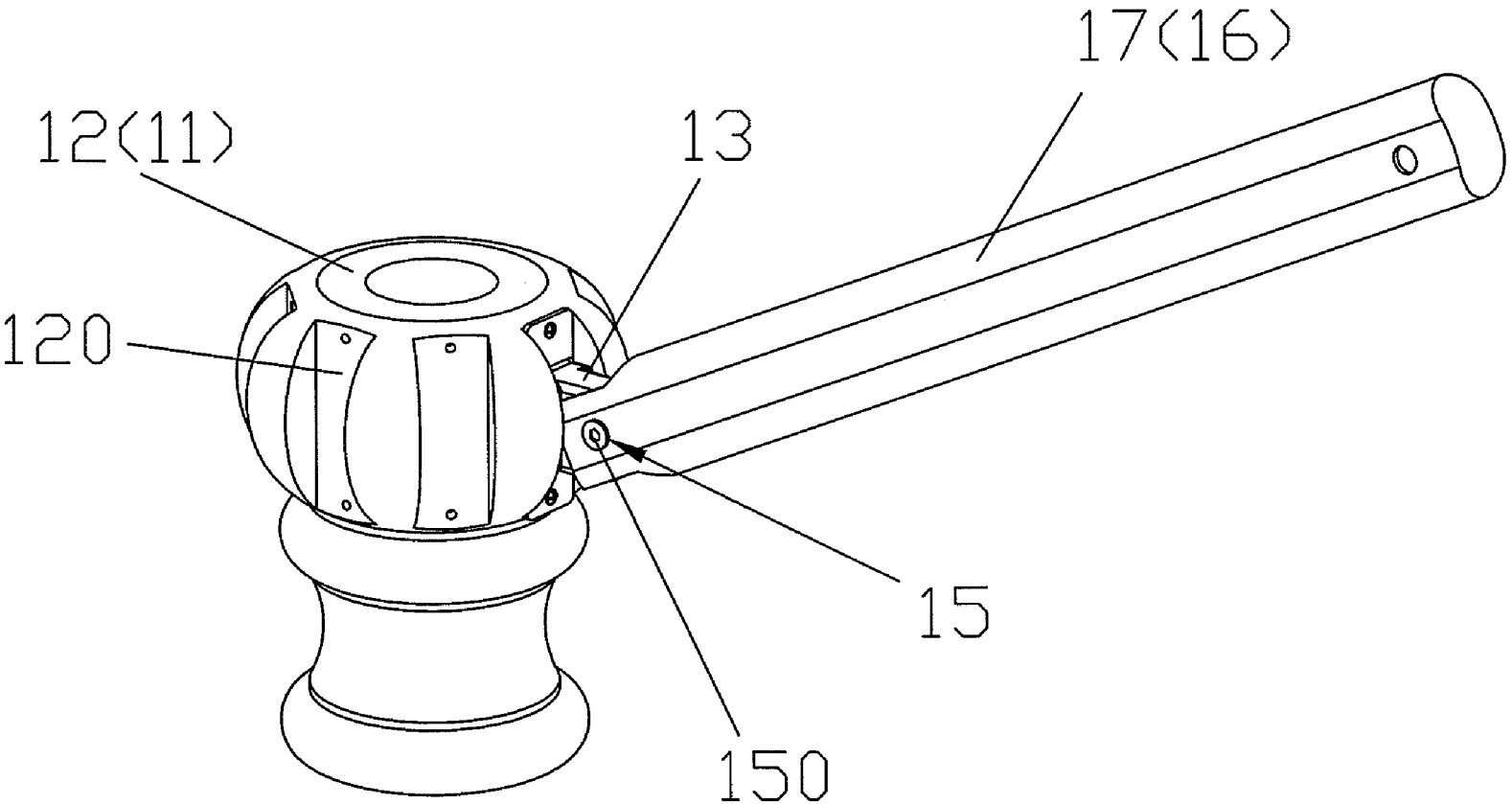
FIG. 10 is a partially perspective view of an umbrella in accordance with another preferred embodiment of the present invention.

Referring to FIG. 10, the umbrella further comprises a plurality of mounting brackets 13 secured on the fixed ring 11 and the movable ring 12 respectively, and a plurality of fastening mechanisms 15 each mounted between a respective one of the mounting brackets 13 and a respective one of the ribs 16 and the spreaders 17 to detachably mount the respective rib 16 and the respective spreader 17 onto the respective mounting bracket 13.

Each of the ribs 16 and the spreaders 17 is pivotally and detachably mounted on the respective mounting bracket 13 by the respective fastening mechanism 15. Each of the mounting brackets 13 is provided with a fixing hole 130 (see FIG. 3) to receive the respective fastening mechanism 15. Each of the spreaders 17 and the ribs 16 is provided with a receiving hole 170 (see FIG. 3) aligning with the fixing hole 130 of the respective mounting bracket 13. Each of the fastening mechanisms 15 includes two juxtaposed threaded sleeves 150 extending through the receiving hole 170 of the respective spreader 17 and the respective rib 16, and a threaded rod 151 (see FIG. 3) screwed into the two threaded sleeves 150 to connect the two threaded sleeves 150.

Figure 11:
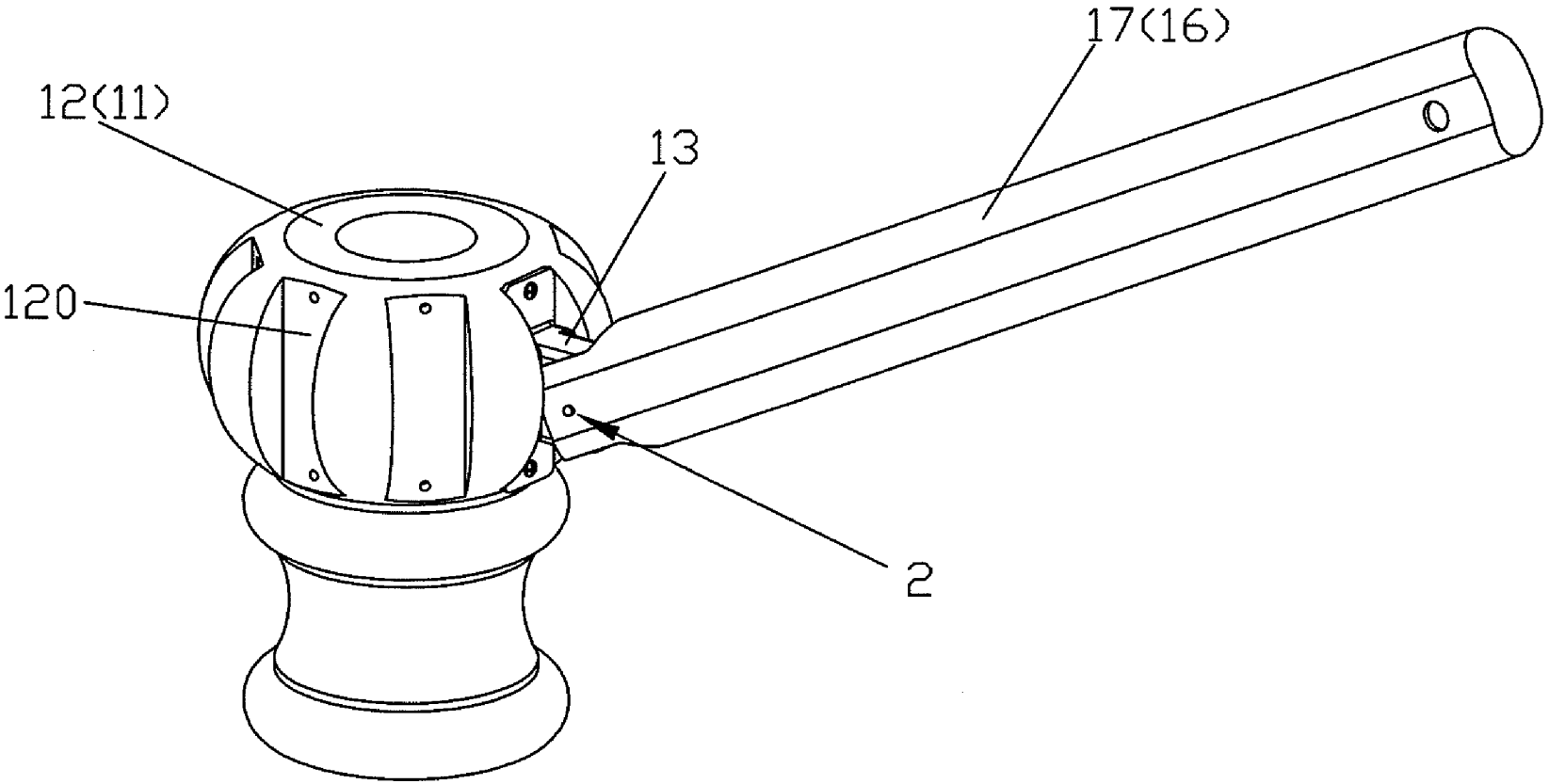
FIG. 11 is a partially perspective view of an umbrella in accordance with another preferred embodiment of the present invention.
Figure 12:
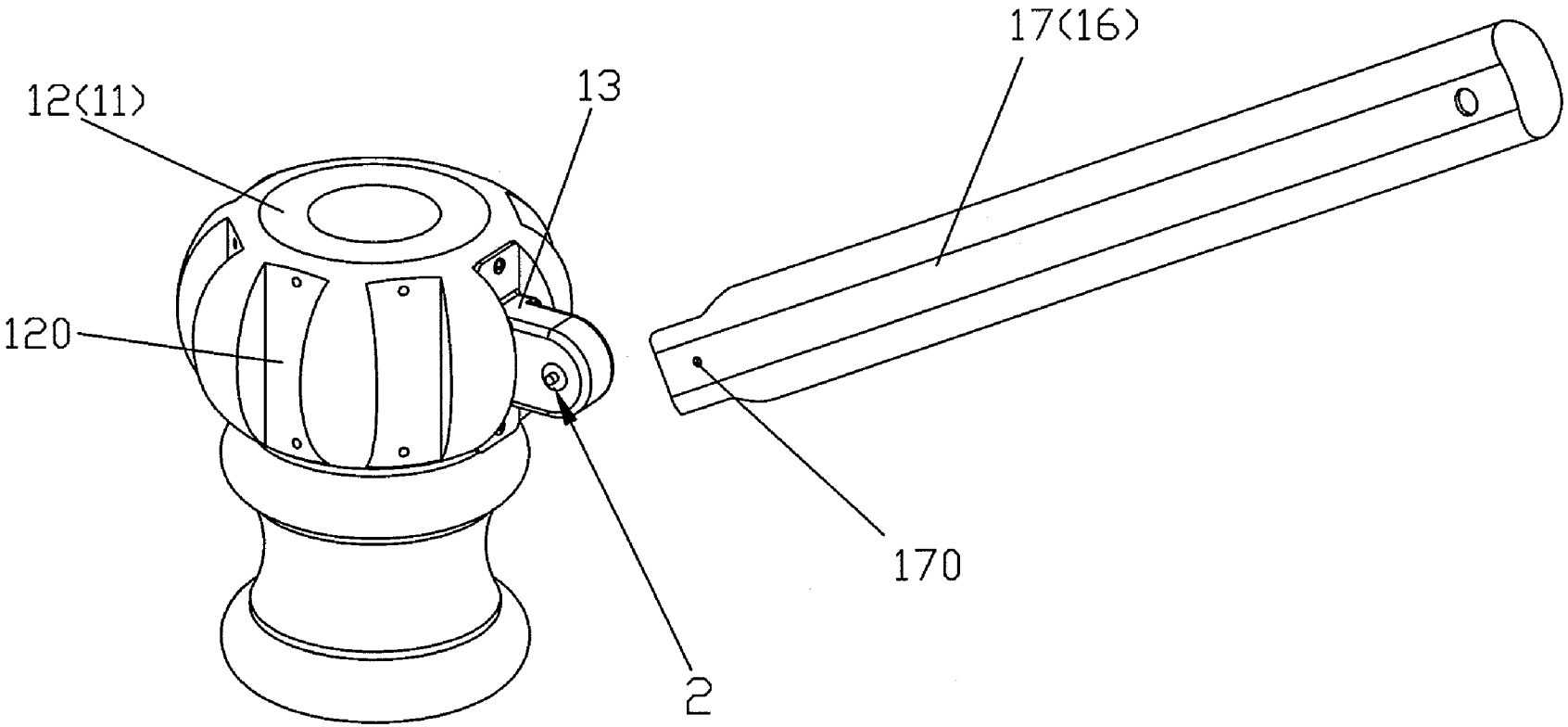
FIG. 12 is an exploded perspective view of the umbrella as shown in FIG. 11.

Referring to FIGS. 11 and 12 with reference to FIGS. 1-9, the umbrella further comprises a plurality of mounting brackets 13 secured on the fixed ring 11 and the movable ring 12 respectively, and a plurality of locking mechanisms 2 each mounted in a respective one of the mounting brackets 13 and each detachably locked onto a respective one of the ribs 16 and the spreaders 17 to detachably lock each of the ribs 16 and the spreaders 17 onto the respective mounting bracket 13.

Each of the ribs 16 and the spreaders 17 is pivotally and detachably mounted on the respective mounting bracket 13 by the respective locking mechanism 2. Each of the mounting brackets 13 is provided with a fixing hole 130 to receive the respective locking mechanism 2. Each of the spreaders 17 and the ribs 16 is provided with a receiving hole 170 aligning with the fixing hole 130 of the respective mounting bracket 13.

Each of the locking mechanisms 2 includes at least one locking stub 21 movably mounted in the fixing hole 130 of the respective mounting bracket 13 and detachably locked in the receiving hole 170 of the respective spreader 17 and the respective rib 16 to detachably lock the respective spreader 17 and the respective rib 16 onto the respective mounting bracket 13, and at least one elastic member 22 mounted in the fixing hole 130 of the respective mounting bracket 13 and pressing the locking stub 21 to push the locking stub 21 outwardly from the receiving hole 170 of the respective spreader 17 and the respective rib 16.

Each of the locking mechanisms 2 further includes at least one housing 20 secured in the fixing hole 130 of the respective mounting bracket 13 to receive the locking stub 21 and the elastic member 22, and at least one fixing plate 23 secured in the housing 20 and abutting the elastic member 22. The locking stub 21 of each of the locking mechanisms 2 has a first end provided with an enlarged limit plate 212 movably mounted in the housing 20 and movable to abut a peripheral wall of the housing 20 to limit the locking stub 21 on the housing 20. The locking stub 21 of each of the locking mechanisms 2 has a second end provided with an arcuate guide portion 210 protruding outwardly from the receiving hole 170 of the respective spreader 17 and the respective rib 16 to guide movement of the locking stub 21 in the receiving hole 170 of the respective spreader 17 and the respective rib 16. The elastic member 22 of each of the locking mechanisms 2 is biased between the fixing plate 23 and the limit plate 212 of the locking stub 21.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An umbrella, comprising:

a shank;

a fixed ring mounted on the shank;

a movable ring movably mounted on the shank;

a plurality of ribs each pivotally and detachably connected with the fixed ring;

a plurality of spreaders each pivotally and detachably connected with the movable ring;

a plurality of mounting brackets secured on the fixed ring and the movable ring respectively;

a plurality of connecting pipes each pivotally and detachably connected with a respective one of the mounting brackets;

a plurality of fastening mechanisms each mounted between a respective one of the mounting brackets and a respective one of the connecting pipes to detachably mount the respective connecting pipe onto the respective mounting bracket;

a plurality of locking mechanisms each mounted in a respective one of the ribs and the spreaders and each detachably locked onto a respective one of the connecting pipes to detachably lock each of the ribs and the spreaders onto the respective connecting pipe;

wherein each of the mounting brackets is provided with a fixing hole to receive the respective fastening mechanism;

each of the connecting pipes has an end portion provided with a forked pivot ear pivotally and detachably mounted on the respective mounting bracket;

the pivot ear of each of the connecting pipes is provided with a pivot hole aligning with the fixing hole of the respective mounting bracket;

each of the fastening mechanisms includes:

two juxtaposed threaded sleeves extending through the pivot hole of the respective connecting pipe and the fixing hole of the respective mounting bracket;

a threaded rod screwed into the two threaded sleeves to connect the two threaded sleeves.

2. The umbrella of claim 1, wherein each of the connecting pipes is pivotally and detachably mounted on the respective mounting bracket by the respective fastening mechanism;

each of the ribs is detachably mounted on the respective connecting pipe by the respective locking mechanism;

each of the spreaders is detachably mounted on the respective connecting pipe by the respective locking mechanism.

3. The umbrella of claim 1, wherein each of the two threaded sleeves of each of the fastening mechanisms has an end portion provided with an enlarged limit flange protruding outwardly from the pivot hole of the respective connecting pipe and abutting the pivot ear of the respective connecting pipe.

4. The umbrella of claim 3, wherein the limit flange of each of the two threaded sleeves has a surface provided with a hexagonal drive slot.

5. The umbrella of claim 1, wherein the threaded rod of each of the fastening mechanisms is received in the two threaded sleeves.

6. The umbrella of claim 1, wherein the fixed ring has a periphery provided with a plurality of receiving grooves to receive the mounting brackets respectively;

the movable ring has a periphery provided with a plurality of receiving grooves to receive the mounting brackets respectively;

each of the mounting brackets is secured in the respective receiving groove of the fixed ring and the respective receiving groove of the movable ring by a plurality of locking screws.

7. An umbrella, comprising:

a shank;

a fixed ring mounted on the shank;

a movable ring movably mounted on the shank;

a plurality of ribs each pivotally and detachably connected with the fixed ring;

a plurality of spreaders each pivotally and detachably connected with the movable ring;

a plurality of mounting brackets secured on the fixed ring and the movable ring respectively;

a plurality of connecting pipes each pivotally and detachably connected with a respective one of the mounting brackets;

a plurality of fastening mechanisms each mounted between a respective one of the mounting brackets and a respective one of the connecting pipes to detachably mount the respective connecting pipe onto the respective mounting bracket;

a plurality of locking mechanisms each mounted in a respective one of the ribs and the spreaders and each detachably locked onto a respective one of the connecting pipes to detachably lock each of the ribs and the spreaders onto the respective connecting pipe;

wherein each of the connecting pipes is provided with at least one locking hole to releasably lock the respective locking mechanism;

each of the spreaders and the ribs is provided with a receiving hole to receive a respective one of the locking mechanisms;

each of the locking mechanisms includes:

at least one locking stub movably mounted in the receiving hole of the respective spreader and the respective rib and detachably locked in the locking hole of the respective connecting pipe to detachably lock the respective spreader and the respective rib onto the respective connecting pipe;

at least one elastic member mounted in the receiving hole of the respective spreader and the respective rib and pressing the locking stub to push the locking stub outwardly from the locking hole of the respective connecting pipe;

at least one housing secured in the receiving hole of the respective spreader and the respective rib to receive the locking stub and the elastic member;

at least one fixing plate secured in the housing and abutting the elastic member.

8. The umbrella of claim 7, wherein the locking stub of each of the locking mechanisms has a first end provided with an enlarged limit plate movably mounted in the housing and movable to abut a peripheral wall of the housing to limit the locking stub on the housing;

the locking stub of each of the locking mechanisms has a second end provided with an arcuate guide portion protruding outwardly from the locking hole of the respective connecting pipe to guide movement of the locking stub in the locking hole of the respective connecting pipe;

each of the connecting pipes has an inner portion provided with a receiving chamber connected to the locking hole to receive a respective one of the ribs and the spreaders.

* * * * *